US007028918B2

(12) United States Patent
Buchanan et al.

(10) Patent No.: US 7,028,918 B2
(45) Date of Patent: Apr. 18, 2006

(54) FUEL INJECTOR HAVING A NOZZLE WITH IMPROVED COOLING

(75) Inventors: David L. Buchanan, Westport, IN (US); Lester L. Peters, Columbus, IN (US); C. Edward Morris, Columbus, IN (US)

(73) Assignee: Cummins Engine Company, Inc., Columbus, IN (US)

( * ) Notice: Subject to any disclaimer, the term of this patent is extended or adjusted under 35 U.S.C. 154(b) by 0 days.

(21) Appl. No.: 09/777,953

(22) Filed: Feb. 7, 2001

(65) Prior Publication Data

US 2003/0155432 A1 Aug. 21, 2003

(51) Int. Cl.
*B05B 15/00* (2006.01)

(52) U.S. Cl. ..... 239/132.3; 239/132; 239/533.3

(58) Field of Classification Search ..... 239/128, 239/132, 132.3, 533.3, 533.9, 533.11
See application file for complete search history.

(56) References Cited

U.S. PATENT DOCUMENTS

| | | | | | |
|---|---|---|---|---|---|
| 1,982,023 | A | * | 11/1934 | Ritz | 239/90 |
| 2,175,450 | A | * | 10/1939 | Thege | 123/41.31 |
| 2,231,937 | A | * | 2/1941 | Meyer et al. | 239/132.3 |
| 2,699,358 | A | * | 1/1955 | Sonderegger | 239/132.3 |
| 3,128,948 | A | * | 4/1964 | Luca | 239/132.3 |
| 3,945,353 | A | | 3/1976 | Dreisin | |
| RE35,079 | E | | 11/1995 | Sverdlin | |
| 5,860,394 | A | | 1/1999 | Saito et al. | |
| 5,884,850 | A | | 3/1999 | Norgauer | |
| 6,000,638 | A | * | 12/1999 | Martin | 239/533.2 |
| 6,053,432 | A | * | 4/2000 | Stevens | 239/533.2 |
| 6,196,195 | B1 | | 3/2001 | Trutschel et al. | |
| 6,460,785 | B1 | * | 10/2002 | Popp | 239/533.2 |

FOREIGN PATENT DOCUMENTS

| | | |
|---|---|---|
| AT | 188969 | 4/1956 |
| AU | 204195 | 11/1956 |
| DE | 1 526 709 | 10/1972 |
| DE | 27 25 707 | 12/1978 |
| DE | 38 31 991 | 3/1980 |
| DE | 196 26 576 A1 | 1/1998 |
| DE | 197 43 103 A1 | 4/1999 |
| GB | 299635 | 11/1928 |

* cited by examiner

*Primary Examiner*—Christopher Kim
(74) *Attorney, Agent, or Firm*—Nixon Peabody LLP; Tim L. Brackett, Jr.; J. Bruce Schelkopf

(57) ABSTRACT

A fuel injector having a nozzle with improved cooling including a retainer and a nozzle housing received therein. The nozzle housing includes a nozzle shank, an outer peripheral surface and at least one injection hole at a tip of the nozzle shank. The nozzle shank is positioned in a nozzle support portion of the retainer. In one embodiment, the outer peripheral surface of the nozzle shank is tapered, and the inner peripheral surface of the nozzle support portion is correspondingly tapered and sized to engage the outer peripheral surface of the nozzle shank along a tapered interface. In another embodiment, the inner peripheral surface of the nozzle support portion has a diameter smaller than a diameter of the outer peripheral surface of the nozzle shank so that an interference fit exists at a seal interface. In yet another embodiment, a nozzle seal seals an interface between the inner peripheral surface of the retainer and the outer peripheral surface of the nozzle shank to thereby prevent entry of hot gases into the interface. In another embodiment, the nozzle support portion is provided on a nozzle sleeve.

11 Claims, 4 Drawing Sheets

FUEL INJECTOR HAVING A NOZZLE WITH IMPROVED COOLING

BACKGROUND OF THE INVENTION

1. Field of the Invention

The present invention relates to the field of fuel injectors and more specifically, to fuel injectors having a nozzle with improved cooling.

2. Description of Related Art

Fuel injectors have been commonly used with internal combustion engines such as diesel engines to deliver combustible fuel to the combustion chambers within the cylinders of the engine. Various injector designs have been implemented in the art but most fuel injectors have a nozzle with a valve element movably disposed therein in which when opened, provides a spray of fuel into the combustion chamber of the cylinder. In this regard, fuel injectors typically include a nozzle including an outer barrel, a retainer, and a nozzle housing that houses the valve element of the fuel injector. The fuel injector is typically mounted to an injector bore in the cylinder head of the internal combustion engine and the nozzle housing having an injection hole generally extends at least partially into the combustion chamber so that fuel may be provided therethrough. In this regard, the retainer is received within the injector bores of the cylinder head and includes an opening proximate to the combustion chamber of the cylinder which allows the nozzle housing to extend into the combustion chamber. Such nozzle designs are generally illustrated in U.S. Pat. No. 5,441,027 to Buchanan et al.

The injector holes are typically provided at the tip of the nozzle shank of the nozzle housing and can be exposed to high temperatures in the combustion chamber of the cylinder during engine operation. It is not uncommon for flame temperatures in the combustion chamber to exceed 4000° Fahrenheit. Generally in the process of normal fuel injection, the fuel itself serves as a media which cools the injector and the tip of the nozzle shank as the pressurized fuel is sprayed from the injector hole. In addition, further cooling of the injector has been obtained by providing a water jacket around the fuel injector in which a cooling medium (such as engine coolant) is circulated to reduce the injector temperature. In this regard, a cost effective solution is to provide coolant passages open to the injector bore within the cylinder head, and to form a water jacket by inserting a coolant jacket sleeve made of copper or stainless steel into the injector bore to thereby segregate the coolant jacket from the injector. Thus, in this manner, efficient reduction in injector temperature has been readily attained and is currently used in many internal combustion engine applications.

More recently however, there has been a tremendous push to increase fuel efficiencies and reduce emissions in internal combustion engines, and in particular, in diesel engines. In a quest to attain these goals in which the injectors and the fuel systems operation must be optimized, engineers have utilized the fuel injectors to provide reduced injection flows such as in pilot injection, preinjection, and/or through the use of a second injector. In many such applications, the quantity of fuel injected is relatively small (less than 5 $mm^3$/stroke). The present applicants have found that the cooling provided by the fuel flowing through the injector and being sprayed is insufficient to cool the tip of the nozzle. In such situations, the tip of the nozzle shank can experience temperatures in excess of its tempering temperature which is commonly approximately 450° Fahrenheit. Consequently, heat deformation of the nozzle tip and fuel coking have been identified by the present applicants as a direct result of insufficient cooling. Moreover, with the advent of increased emissions regulations, alternative fuels and blends thereof have been pursued to provide alternative combustible fuels that may be used in various internal combustion engines such as modified diesel engines. However, such alternative fuels have different burn temperatures and characteristics, and certain fuels such as natural gas has a tendency to burn with a combustion flame which is positioned closer to the tip of the nozzle thereby exposing the tip of the nozzle to much higher temperatures than those experienced during normal diesel fuel combustion.

In addition to the above described method for reducing injector temperature by providing water jackets around the injector, there have been various devices and methods proposed for reducing the temperature of the tip of the nozzle tip during operation of the internal combustion engine. In particular, the Australian Patent No. 204195 discloses an injector including a joint tightening cone with a central opening to receive the nozzle housing therethrough. This reference discloses that the cone is made of a different material than the nozzle and is made of material having good heat conduction such as aluminum or copper. During operation of the internal combustion engine, the cone expands to tightly contact the nozzle shank of the nozzle housing thereby preventing heating of the nozzle tip that may be caused by entrance of combustion gases at the interface of the cone and the nozzle shank. The reference further discloses that a very favorable heat transmission conditions from the nozzle tip to the cooled cylinder head is provided via the cone. The disadvantage of the invention disclosed in this reference is that it requires a cone having a different material composition than the rest of the injector which may increase manufacturing costs and further complicate the operation of the injector due to the differing expansion and contraction characteristics of the cone as compared to various other components of the injector. In another approach, U.S. Pat. No. 5,860,394 discloses an injector having a nozzle tip which has an approximately 45° angle tapered nozzle tip surface which abuts a heat insulator that reduces the heat conducted from the cylinder head to the injector tip and further serves as a seal against the coolant flowing around the injector. The disadvantage of this design is that it is highly sensitive to manufacturing tolerance variances and is susceptible to failure due to the reduced material thickness of the cylinder head caused by the coolant passage that must flow very close to the nozzle tip.

Therefore, there exists an unfulfilled need for an improved fuel injector having a nozzle with improved cooling. In particular, there exists an unfulfilled need for such a nozzle that will increase reliability and performance of the fuel injector. In this regard, there is an unfulfilled need for such a nozzle which is sealed to prevent entry of combustion gases to thereby prevent heat transfer from the combustion gases to the nozzle without the disadvantages of the prior art designs, especially when the fuel injector is used for pilot injections or used with alternative fuels.

SUMMARY OF THE INVENTION

In view of the foregoing, it is an object of the present invention to provide an improved fuel injector having a nozzle with improved cooling.

A second object of the present invention is to provide an improved fuel injector nozzle having increased reliability and performance.

A third object of the present invention is to provide an improved fuel injector nozzle in which the nozzle is sealed to prevent entry of combustion gases to thereby prevent heat transfer from the combustion gases to the nozzle.

Yet another object of the present invention is to provide such an improved fuel injector nozzle which will avoid problems of prior art nozzles, especially when the fuel injector is used for pilot injections or used with alternative fuels.

In accordance with the preferred embodiments of the present invention, these and other objects are obtained by a fuel injector having a nozzle with improved cooling for an internal combustion engine comprising a substantially tubular retainer and a nozzle housing received within the retainer. The retainer has a proximal end with a nozzle support portion, the nozzle support portion having an outer peripheral surface and an engagement opening with an inner peripheral surface. The nozzle housing includes a nozzle shank with a longitudinal axis, an outer peripheral surface and at least one injection hole at a tip of the nozzle shank which is adapted to spray fuel. The nozzle shank is positioned in the nozzle support portion of the retainer. In accordance with this embodiment of the present invention, the outer peripheral surface of the nozzle shank is tapered with respect to the longitudinal axis, and the inner peripheral surface of the nozzle support portion is correspondingly tapered with respect to the longitudinal axis and is sized to engage the outer peripheral surface of the nozzle shank along a tapered interface. In this embodiment, the length of the tapered interface may preferably be greater than a diameter of the nozzle shank. Additionally, the outer peripheral surface of the nozzle shank and the inner peripheral surface of the nozzle support portion may be tapered between 0.5 to 15 degrees. Preferably, in this embodiment, the retainer includes a nozzle sleeve, wherein the nozzle support portion is provided on the nozzle sleeve. The outer peripheral surface of the nozzle shank and the inner peripheral surface of the nozzle support portion are most preferably tapered approximately between 1 to 2 degrees with respect to the longitudinal axis. The fuel injector may be adapted to be received in an injector bore of a cylinder head of the internal combustion engine, and the outer peripheral surface of the nozzle support portion directly contacts either the injector bore of the cylinder head or the coolant jacket sleeve installed in the injector bore.

In accordance with another embodiment of the present invention, a fuel injector comprises a substantially tubular retainer and a nozzle housing received within the retainer. The retainer has a proximal end with a nozzle support portion, the nozzle support portion having an outer peripheral surface and an engagement opening with an inner peripheral surface. The nozzle housing includes a nozzle shank with an outer peripheral surface and at least one injection hole at a tip of the nozzle shank which is adapted to spray fuel. The nozzle shank is positioned in the nozzle support portion of the retainer. In accordance with this embodiment, the inner peripheral surface of the nozzle support portion has a diameter smaller than a diameter of the outer peripheral surface of the nozzle shank so that an interference fit exists at a seal interface between the nozzle shank and the nozzle support portion when the nozzle shank is installed in the nozzle support portion. In one embodiment, the diameter of the inner peripheral surface of the nozzle support portion may be sized approximately 0.00005 to 0.001 inch smaller than the diameter of the outer peripheral surface of the nozzle shank. In another embodiment, the diameter of the inner peripheral surface of the nozzle support portion is sized approximately 0.0001 to 0.0006 inch smaller than the diameter of the outer peripheral surface of the nozzle shank. The nozzle support portion of the present embodiment may also be provided with a chamfer adapted to facilitate installation of the nozzle shank. The nozzle shank may be press fitted into the engagement opening of the nozzle support portion. Of course, in other embodiments, the retainer may further include a nozzle sleeve where the nozzle support portion is provided on the nozzle sleeve.

In accordance with still another embodiment of the present invention, a fuel injector comprises a substantially tubular retainer and a nozzle housing received within the retainer. The retainer has a proximal end with a nozzle support portion, the nozzle support portion having an outer peripheral surface and an engagement opening with an inner peripheral surface. The nozzle housing includes a nozzle shank with an outer peripheral surface and at least one injection hole at a tip of the nozzle shank which is adapted to spray fuel. The nozzle shank is positioned in the nozzle support portion of the retainer. In accordance with this embodiment, the fuel injector further includes a nozzle seal adapted to seal an interface between the inner peripheral surface of the nozzle support portion and the outer peripheral surface of the nozzle shank to thereby prevent entry and accumulation of hot gas at the interface. The nozzle support portion may include a flange on the inner peripheral surface, and the nozzle shank may include an abutment on its outer peripheral surface that is axially spaced from the flange to thereby form a seal compartment between the inner peripheral surface of the retainer and the outer peripheral surface of the nozzle shank when the nozzle housing is received within the retainer. In addition, the nozzle seal may preferably be a metallic washer disposed in the seal compartment and is made of steel or copper. In this regard, the present embodiment may also be provided with a compliant ring disposed in the seal compartment adjacent to the nozzle seal to compensate for axial tolerance variances between the retainer and the nozzle housing when the nozzle housing is received within the retainer. The compliant ring may have a C-shaped cross-section and may be made of steel or copper.

In accordance with yet another embodiment of the present invention, a fuel injector comprises a nozzle housing with an outer peripheral surface, a valve cavity therein, a valve seat disposed in the valve cavity, and at least one injection hole at a tip of the nozzle housing which is adapted to spray fuel. The fuel injector also comprises a valve element disposed in the valve cavity of the nozzle housing, the valve element being operable between a closed position in which the valve element is seated against the valve seat to thereby prevent injection of fuel through the injection hole, and an open position in which the valve element is lifted off the valve seat to thereby allow injection of fuel through the injection hole. In accordance with this embodiment of the present invention, the outer peripheral surface of the nozzle housing directly contacts either the injector bore of the cylinder head or the coolant jacket sleeve installed in the injector bore. In this regard, the outer peripheral surface of the nozzle housing is preferably conical in shape and directly contacts the coolant jacket sleeve installed in the injector bore.

These and other objects, features and advantages of the present invention will become more apparent from the following detailed description of the invention when viewed in conjunction with the accompanying drawings.

DETAILED DESCRIPTION OF THE PREFERRED EMBODIMENT

Various improved fuel injectors are described herein below which have nozzles with improved cooling in accordance with the preferred embodiments of the present invention. As will be evident to one skilled in the art, a fuel injector incorporating the features of the present invention as described below has increased reliability and performance. This is attained by sealing the nozzle from the entry of combustion gases to thereby prevent heat transfer from combustion gases to the nozzle. By practicing the teachings of the present invention, the problems associated with high nozzle temperatures present in prior art fuel injectors can thus be minimized, especially when the injector is used for pilot injections or alternative fuels are used.

Figure 1:
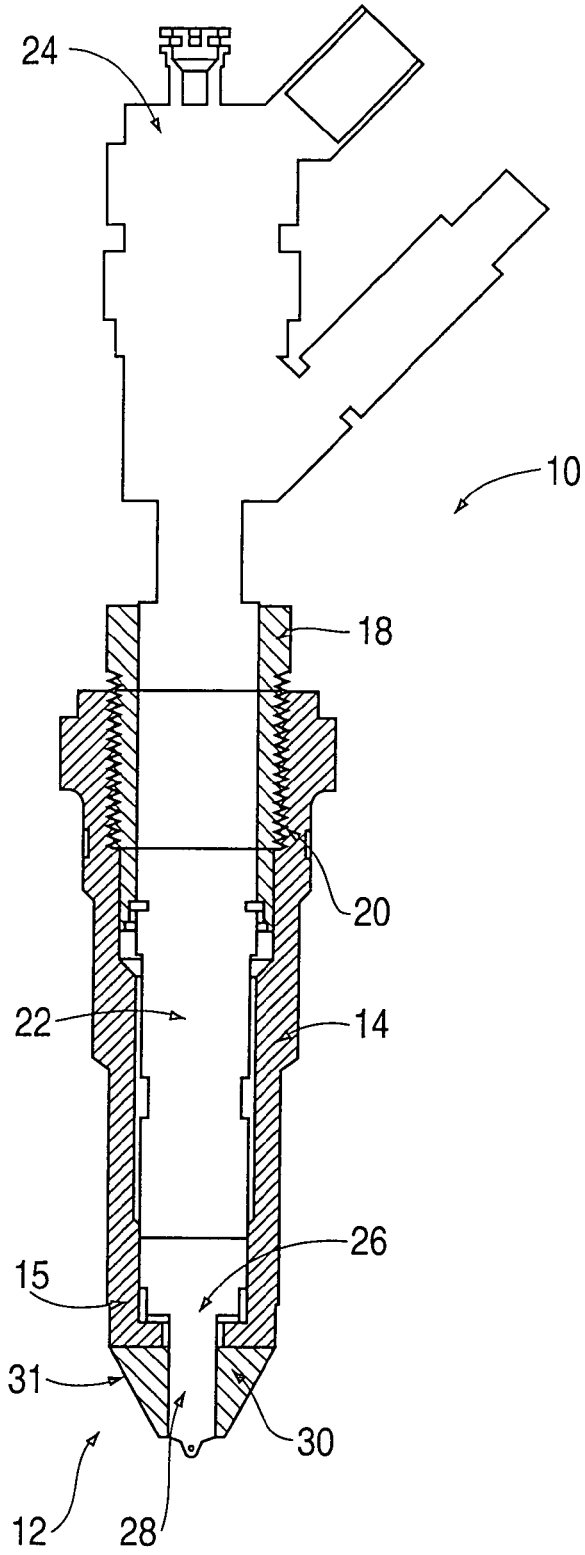
FIG. 1 is a partially schematic and partially cross-sectional view of an improved fuel injector having a nozzle with improved cooling in accordance with one embodiment of the present invention.

FIG. 1 illustrates a partially schematic and partially cross-sectional view of an improved fuel injector 10 having a nozzle 12 with improved cooling in accordance with one embodiment of the present invention. It should be evident to a person of ordinary skill in the art that only certain components of the fuel injector 10 has been illustrated in cross-sectional detail. The specific details of the schematically illustrated components are not required to fully explain or understand the present invention and thus, have been omitted in the drawings and in the discussion herein below to simplify the explanation of the present invention.

As can be readily recognized, the illustrated fuel injector 10 includes a nozzle 12 that has a substantially tubular retainer 14 and a nozzle housing 16 which will be discussed in further detail below. As can be also seen, the illustrated fuel injector 10 also includes various other components as well as the components of the nozzle 12. In this regard, the retainer 14 threadingly engages the outer barrel 18 via threads 20 thereby retaining the various fuel injector components indicated generally by numeral 22 housed within the retainer 14. These fuel injector components 22 may include components such as valves, plungers, springs, pistons, etc. which are well known in the fuel injector art. Other injector components such as the control valve 24 which is actuable to operate the fuel injector 10 is also schematically shown. As noted previously, these schematically illustrated components are not required to understand or practice the present invention and should not be construed to limit the scope of the present invention but are merely illustrated to clarify the surrounding environmental components to which the present invention is applied. In this regard, it should also be noted that the present invention may be applied to fuel injectors of various designs including fuel injectors commonly referred to as unit injectors, common rail injectors, pump controlled injectors, distributor injectors, and others.

In the embodiment of the present invention illustrated in FIG. 1, the fuel injector 10 also includes a nozzle housing 26 received within the retainer 14, the nozzle housing including a nozzle shank 28 that houses a valve element (not shown) such as a needle valve also known in the fuel injector art. The nozzle shank 28 is positioned in a nozzle support portion which in the present embodiment, is provided on a nozzle sleeve 30 at a proximal end 15 of the retainer 14 close to the combustion chamber of the internal combustion engine (not shown). As can be seen, in the illustrated embodiment, the nozzle sleeve 30 is a separate part of the retainer 14 and has an inverse conical shape with an outer peripheral surface 31. The nozzle shank 28 and the nozzle sleeve 30 are more clearly shown in FIG. 2 and are provided with features of the present invention which seal the nozzle 12 to prevent entry of combustion gases into the nozzle 12 thereby preventing heat transfer from combustion gases to the nozzle as discussed in further detail below and consequently, providing a nozzle with improved cooling.

Figure 2:
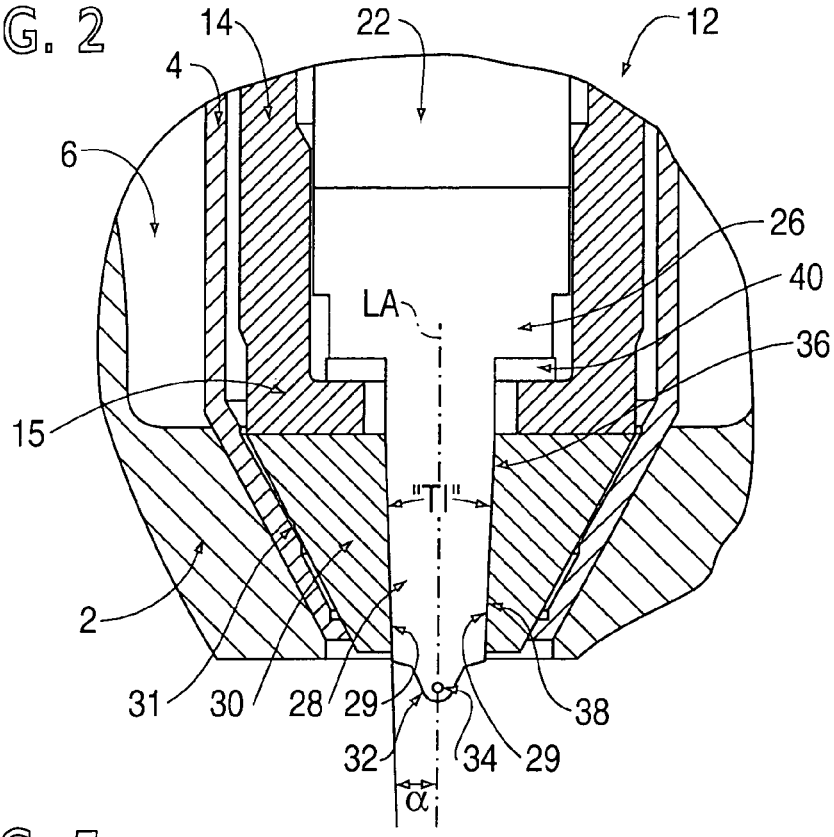
FIG. 2 is an enlarged cross-sectional view of the nozzle of the fuel injector as shown in FIG. 1 received in an injector bore with a coolant jacket sleeve installed in the injector bore.

FIG. 2 shows an enlarged cross-sectional view of the nozzle 12 of the fuel injector 10 as shown in FIG. 1 except that the fuel injector 10 has been installed into an injector bore of a cylinder head 2 of an internal combustion engine (not shown). In this regard, a coolant jacket sleeve 4 is installed in the injector bore to thereby form a coolant jacket 6 which surrounds the nozzle 12. The outer peripheral surface 31 of the nozzle sleeve 30 directly contacts the coolant jacket sleeve 4 in the manner shown thereby facilitating the cooling of the fuel injector 10 and the nozzle 12. Such coolant jacket sleeves 4 are typically made from copper alloys or various corrosion resistant steels and are well known in the art and thus, need not be discussed further. In addition, in other fuel injector applications, the injector bore need not be provided with the coolant jacket sleeve 4 as shown. In such applications, the outer peripheral surface 31 of the nozzle sleeve 30 can directly contact the cylinder head 2 and is cooled by the transferring heat to the cylinder head 2.

As can be readily seen, the nozzle shank 28 of the nozzle housing 26 has a longitudinal axis "LA", an outer peripheral surface 29 and at least one injection hole 34 at a tip 32 of the nozzle shank 28 which is adapted to spray fuel. The nozzle housing 26 is received within the retainer 14 in the manner shown so that the nozzle shank 28 is positioned in the nozzle sleeve 30. In this regard, the nozzle sleeve 30 is provided with an engagement opening 36 with an inner peripheral surface 38. An annular spacer 40 may be used to aid and ensure proper axial positioning of the nozzle housing 26 relative to the various components 22 and the nozzle sleeve 30. It should also be noted that in FIG. 2, the nozzle housing 26 and the nozzle shank 28 is merely shown in schematic form to allow more clear illustration of the tapered feature of the present invention as discussed in further detail below.

In accordance with the illustrated embodiment of the present invention of FIG. 2, the outer peripheral surface 29 of the nozzle shank 28 is tapered a degrees with respect to the longitudinal axis LA. Moreover, the inner peripheral surface 38 of the nozzle sleeve 30 is correspondingly tapered α degrees with respect to the longitudinal axis LA and is sized to engage the outer peripheral surface 29 of the nozzle shank 28 along a tapered interface "TI". In this embodiment, the length of the tapered interface TI is preferably greater than a diameter of the nozzle shank 28 and the taper angle α is between 0.5 to 15 degrees relative to the longitudinal axis LA. In other words, the outer peripheral surface 29 of the nozzle shank 28 and the inner peripheral surface 38 of the nozzle sleeve 30 are tapered between 0.5 to 15 degrees relative to the longitudinal axis LA. In this regard, the outer peripheral surface 29 of the nozzle shank 28 and the inner peripheral surface 38 of the nozzle sleeve 30 are most preferably, tapered approximately between 1 to 2 degrees with respect to the longitudinal axis LA.

The present applicants have found that during combustion in the combustion chamber, the hot combustion gases can enter the prior art nozzles along the outer peripheral surface of the nozzle shank thereby increasing the temperature of the nozzle and the fuel injector. As described previously, such hot combustion gases were not a significant problem in conventional diesel fuel injector applications since during normal operation of the diesel engine, sufficient quantities of fuel was injected to cool the nozzle, the injected fuel acting as the cooling medium. However, in fuel injector applications where the fuel injector was used to provide low volume pilot injections or for injecting alternative fuels, the present applicants found that such hot gases can detrimentally impact the performance of the prior art fuel injector or even damage the prior art nozzle. Thus, the embodiment of the present invention eliminates this prior art problem by providing a tight seal to be formed at the tapered interface TI as the components of the fuel injector 10 are retained together by threadingly engaging the retainer 14 with the outer barrel 18 via threads 20. In particular, because of the tapering of the inner peripheral surface 38 of the nozzle sleeve 30, a gas tight seal is created at the tapered interface TI as the tapered outer peripheral surface 29 of the nozzle shank 28 is pressed into the tapered inner peripheral surface 38 of the nozzle sleeve 30. Thus, even at high pressures present during combustion in the combustion chamber, hot combustion gases are prevented from entering the nozzle 12 in accordance with the present invention. Moreover, the present applicants have found that the seal created at the tapered interface TI is very strong when the taper angle α is between 0.5 to 15 degrees relative to the longitudinal axis LA, and the seal created is especially strong when the taper angle α is approximately between 1 to 2 degrees with respect to the longitudinal axis LA because at these angles, the outer peripheral surface 29 of the nozzle shank 28 becomes wedged into the inner peripheral surface 38 of the nozzle sleeve 30. In this manner, by preventing the hot combustion gases from entering and accumulating in the nozzle 12, the present invention provides a fuel injector having a nozzle with improved cooling which attains the objects noted previously.

Furthermore, this improved cooling is attained at minimal cost since the nozzle sleeve 30 may be made of the same materials as the various other components of the fuel injector and need not be made of a different material having different thermal expansion coefficients. Consequently, the problems associated with having different components made from different materials with different thermal expansion coefficients can be avoided. Moreover, by providing the nozzle support portion on a nozzle sleeve 30 which is a separate part of the retainer 14, these two components can be manufactured separately so that if one of the component is not within the required design tolerances, either through manufacturing defect or through wear, only the defective component need to be replaced and the non-defective component can still be used. Thus, for example, the tapered inner peripheral surface 38 of the nozzle sleeve 30 should be carefully manufactured to the desired taper angle α which corresponds to the taper angle of the outer peripheral surface 29 of the nozzle shank 28. If the taper angle α of the inner peripheral surface 38 is not within the allowable tolerance specifications, the nozzle sleeve 30 can be discarded and/or replaced without discarding or replacing the entire retainer 14. Consequently, significant cost savings can be obtained.

Figure 3:
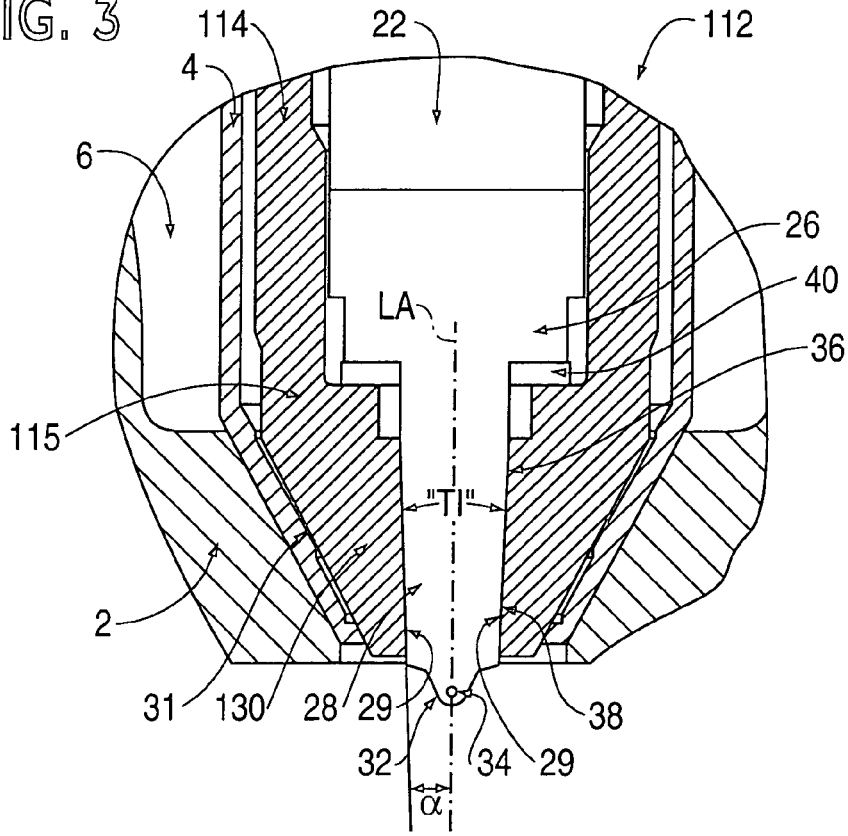
FIG. 3 is an enlarged cross-sectional view of a nozzle of a fuel injector in accordance with another preferred embodiment of the present invention.

FIG. 3 illustrates another preferred embodiment of the present invention which is similar to the embodiment shown in FIG. 2 discussed above. In this regard, the common components have been enumerated with the same numerals while components that are different have been enumerated with different numerals to thereby simplify the description and understanding of this embodiment. As can be seen in FIG. 3, the nozzle 112 is shown installed in an injector bore of a cylinder head 2 with a coolant jacket sleeve 4 which forms the coolant jacket 6 surrounding the nozzle 112. Of course, the present embodiment may also be used with a fuel injector that is installed into the injector bore of the cylinder head 2 without the coolant jacket sleeve 4. Also like the previously described embodiment, the nozzle shank 28 of the nozzle housing 26 has a longitudinal axis "LA", an outer peripheral surface 29 and at least one injection bole 34 at a tip 32 of the nozzle shank 28 which is adapted to spray fuel. In contrast with the previous embodiment however, the nozzle support portion 130 is integrally provided on a proximal end 115 of the retainer 114 instead of being provided on a nozzle sleeve which is a separate part of the retainer. Thus, the nozzle support portion 130 is provided a peripheral outer surface 31 which contacts the coolant jacket sleeve 4. In addition, the nozzle support portion 130 is also provided with an engagement opening 36 and an inner peripheral surface 38, and the nozzle housing 26 is received within the retainer 114 in the manner shown so that the nozzle shank 28 is positioned in the nozzle support portion 130 of the retainer 114. Again, an annular spacer 40 may be used to aid and ensure proper axial positioning of the nozzle housing 26 relative to the various components 22 and the nozzle support portion 130.

The embodiment of FIG. 3 functions similar to the embodiment of FIG. 2 in preventing entry and accumulation of hot gas in the nozzle. Thus, the outer peripheral surface 29 of the nozzle shank 28 is tapered α degrees with respect to the longitudinal axis LA, and the inner peripheral surface 38 of the nozzle support portion 130 of the retainer 114 is correspondingly tapered α degrees with respect to the longitudinal axis LA and sized to engage the outer peripheral surface 29 of the nozzle shank 28 along a tapered interface "TI". Preferably, the length of the tapered interface TI is greater than a diameter of the nozzle shank 28 and the taper angle α is between 0.5 to 15 degrees relative to the longitudinal axis LA. Again, in the most preferred embodiment, the outer peripheral surface 29 of the nozzle shank 28 and the inner peripheral surface 38 of the nozzle sleeve 30 are tapered approximately between 1 to 2 degrees with respect to the longitudinal axis LA. This embodiment, is less cost effective than the embodiment of FIG. 2 described above since any discrepancies or defects caused by wear or manufacturing of the inner peripheral surface 29 of the nozzle support portion 130 requires the replacement of the entire retainer 114 instead of the defective component.

Figure 4:
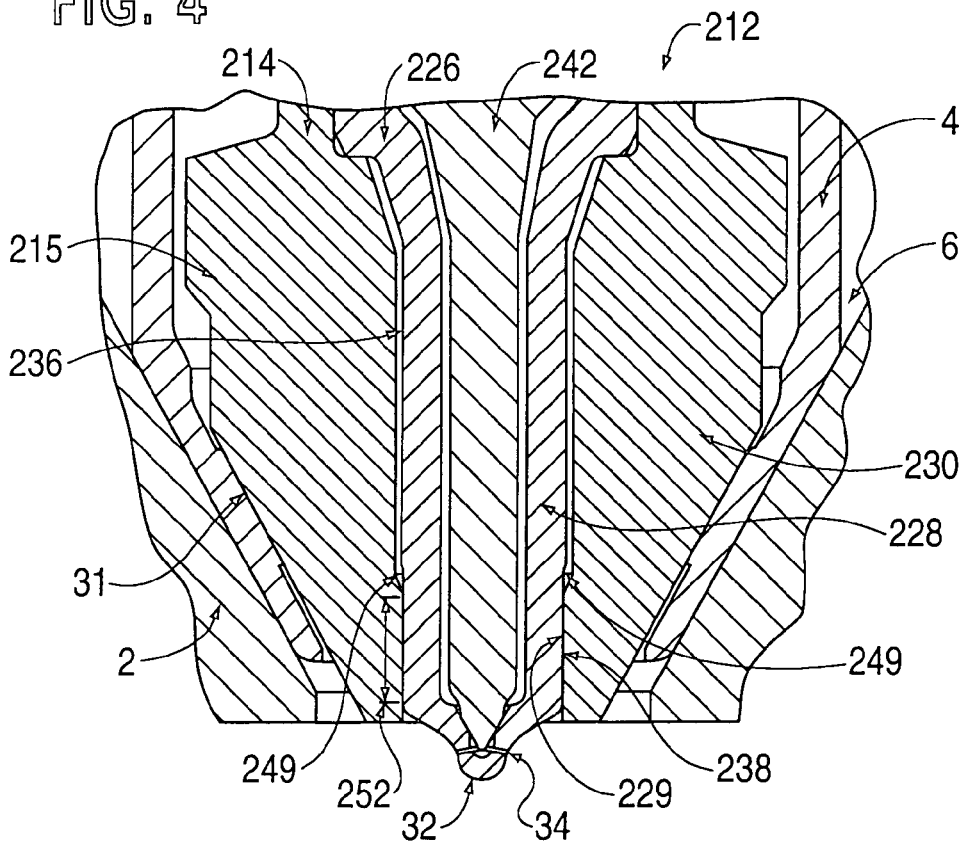
FIG. 4 is an enlarged cross-sectional view of a nozzle of a fuel injector in accordance with still another preferred embodiment of the present invention.

FIG. 4 is an enlarged cross-sectional view of a nozzle 312 of a fuel injector in accordance with another embodiment of the present invention which also prevents entry and accumulation of hot gas into the nozzle 212 to provide a nozzle with improved cooling. Again, the common components have been enumerated with the same numerals while components that are different have been enumerated with different numerals (by increasing the numerals by 200) to thereby simplify the description and understanding of this embodiment. As can be seen, the nozzle 212 is shown installed in an injector bore of a cylinder head 2 with a coolant jacket sleeve 4 which forms the coolant jacket 6 surrounding the nozzle 212, but again, the invention may be used in applications where the fuel injector is installed into the injector bore of the cylinder head 2 without the coolant jacket sleeve 4.

The nozzle shank 228 of the nozzle housing 226 has an outer peripheral surface 229 and at least one injection hole 34 at a tip 32 of the nozzle shank 228 which is adapted to spray fuel. As with the previous embodiment, the nozzle support portion 230 is integrally provided on a proximal end 215 of the retainer 214. However, it should be apparent that based on the teachings of the previous embodiment of FIG. 2 discussed above, the nozzle support portion 230 may be provided on a separate nozzle sleeve. The nozzle support portion 230 is provided with an engagement opening 236 with an inner peripheral surface 238 toward the tip 32, the nozzle housing 226 being received within the retainer 214 in the-manner shown so that the nozzle shank 228 is positioned in the nozzle support portion 230 of the retainer 214. It should also be noted that in FIG. 4, the nozzle housing 226 and the nozzle shank 228 are shown in cross-sectional form to allow more clear illustration of the interference fit feature of the present embodiment as discussed in further detail below. In addition, FIG. 4 also shows the cross sectional view of the valve element 242 which is operably positioned in the nozzle housing 226 to control the spray of fuel through the injection hole 34 in the manner known in the art.

In accordance with the illustrated embodiment of the present invention as shown in FIG. 4, the inner peripheral surface 238 toward the tip of the engagement opening 236 is sized relative to the outer peripheral surface 229 of the nozzle shank 228 so that there is an interference fit along the sealing interface 252. More specifically, to provide a gas tight sealing interface 252, the diameter of the inner peripheral surface 238 of the nozzle support portion 230 is sized approximately 0.00005 to 0.001 inch smaller than the diameter of the outer peripheral surface 229 of the nozzle shank 228 so that there is an interference fit between these components when installed. Preferably, the interference fit is in the range of 0.0001 to 0.0006 inch to ensure proper sealing at the sealing interface 252 without undue stresses on the components. For installation, the nozzle shank 228 may be press fitted in the engagement opening 236 of the nozzle support portion 230 in any manner such as by use a press or merely by threading the components of the injector together such as by threadingly engaging the retainer 14 with the outer barrel 18 via threads 20 as described previously relative to FIG. 1. In addition, a chamfer 249 may be provided in the nozzle support portion 230 to thereby facilitate proper installation of the nozzle shank 228 into the engagement opening 236 in a manner to provide sealing along the sealing interface 252. In this regard, as can be clearly seen in FIG. 4, the inner peripheral surface 238 of the engagement opening 236 which is toward the tip 32 has a reduced diameter as compared to the rest of the engagement opening 236 which in the present illustrated embodiment, has an enlarged diameter, the chamfer 249 being provided at the transition. Thus, in the above described manner, a gas tight seal is attained at the sealing interface 252 via an interference fit thereby providing a fuel injector nozzle having improved cooling.

Figure 5:
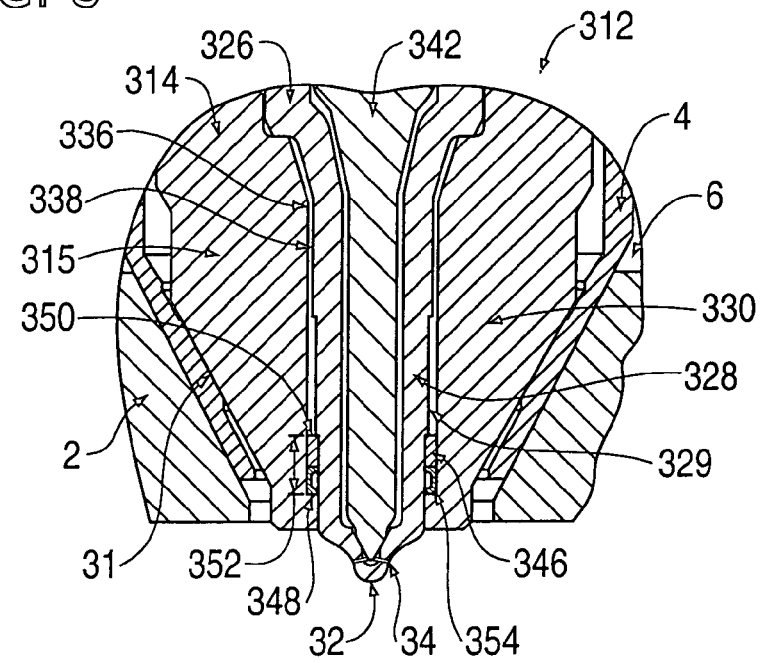
FIG. 5 is an enlarged cross-sectional view of a nozzle of a fuel injector in accordance with yet another preferred embodiment of the present invention.

FIG. 5 is an enlarged cross-sectional view of a nozzle 312 of a fuel injector in accordance with still another preferred embodiment of the present invention which also prevents entry and accumulation of hot gas into the nozzle 312 to provide a nozzle with improved cooling. Again, the common components have been enumerated with the same numerals while components that are different have been enumerated with different numerals (by increasing the numerals by 300) to thereby simplify the description and understanding of this embodiment. As scan be seen, the nozzle 312 is shown installed in an injector bore of a cylinder head 2 with a coolant jacket sleeve 4 which forms the coolant jacket 6 surrounding the nozzle 312, but again, the invention may be used in applications where the fuel injector is installed into the injector bore of the cylinder head 2 without the coolant jacket sleeve 4. The nozzle shank 328 of the nozzle housing 326 has an outer peripheral surface 329 and at least one injection hole 34 at a tip 32 of the nozzle shank 328 which is adapted to spray fuel. As with the previous embodiment, the nozzle support portion 330 is integrally provided on a proximal end 315 of the retainer 314. Again however, it should be apparent that based on the teachings of the previous embodiment of FIG. 2 discussed above, the nozzle support portion 330 may be provided on a separate nozzle sleeve. The nozzle support portion 330 is provided with an engagement opening 336 with an inner peripheral surface 338, the nozzle housing 326 being received within the retainer 314 in the manner shown so that the nozzle shank 328 is positioned in the nozzle support portion 330 of the retainer 314. It should also be noted that in FIG. 5, the nozzle housing 326 and the nozzle shank 328 are shown in cross-sectional form to allow more clear illustration of the nozzle seal feature of the present embodiment as discussed in further detail below. In addition, FIG. 5 also shows the cross sectional view of the valve element 342 which is operably positioned in the nozzle housing 326 to control the spray of fuel through the injection hole 34 in the manner known in the art.

In accordance with the illustrated embodiment of FIG. 5, the nozzle 312 is further provided with a nozzle seal 346 that is adapted to seal the interface between the inner peripheral surface 338 of the nozzle support portion 330 and the outer peripheral surface 329 of the nozzle shank 328 to thereby prevent entry and accumulation of hot gas at the interface. In this regard, the nozzle support portion 330 preferably includes a flange 348 on the inner peripheral surface 338, and the nozzle shank 328 includes an abutment 350 on the outer peripheral surface 329 that is axially spaced from the flange 348 when the nozzle housing 326 is received within the retainer 314 to thereby form a seal compartment 352 between the inner peripheral surface 338 of the nozzle support portion 330 and the outer peripheral surface 329 of the nozzle shank 328. As can be seen, the seal compartment 352 is provided close to the combustion chamber (not shown) so that sealing of the interface may occur. The nozzle seal 346 is disposed in the seal compartment 352 and is preferably a metallic washer such as a washer made of steel or copper. In the illustrated embodiment, the nozzle 312 is also provided with a compliant ring 354 disposed in the seal compartment 352 adjacent to the nozzle seal 346 to thereby ensure proper seating of the nozzle seal 346 and to compensate for axial tolerance variances between the retainer 314 and the nozzle housing 328 when the nozzle housing 328 is received within the retainer 314. In this regard, the compliant ring 354 preferably has a C-shaped cross-section as shown to allow compression thereof and may be made from copper or steel such as spring steel. Thus, the nozzle seal 346 provides a gas tight seal for the nozzle 312 at the interface between the nozzle shank 328 and the nozzle support portion 330 so that even at high pressures present during combustion in the combustion chamber, hot combustion gases are prevented from entering the nozzle 312. In this manner, the illustrated embodiment of FIG. 5 attains the objects of the present invention noted previously to thereby provide a nozzle with improved cooling.

Figure 6:
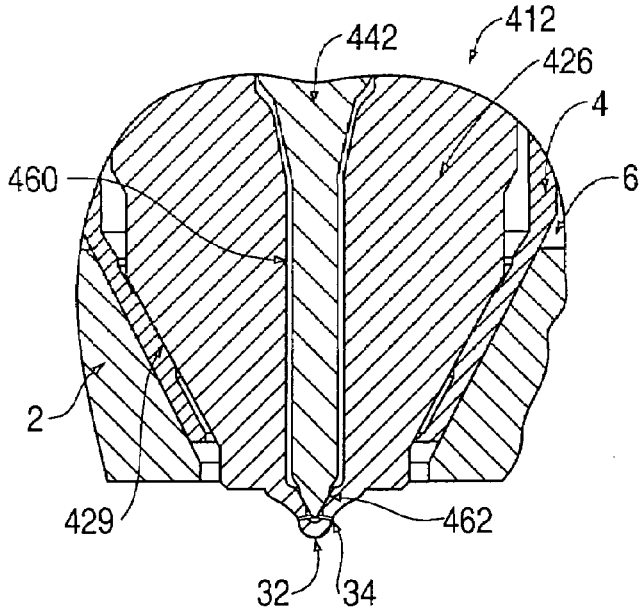
FIG. 6 is an enlarged cross-sectional view of a nozzle of a fuel injector in accordance with still another preferred embodiment of the present invention.

FIG. 6 shows yet another embodiment of a nozzle of a fuel injector in accordance with the present invention, the common components again being enumerated with the same numerals of the previously discussed embodiments. In this embodiment, the nozzle includes a nozzle housing 426 wherein the nozzle support portion described in the previous embodiments have been incorporated with the nozzle housing 426. In this regard, the nozzle housing 426 has an outer peripheral surface 429, a valve cavity 460 therein, a valve seat 462 disposed in the valve cavity 460, and at least one injection hole 34 at a tip of the nozzle housing 426 that is adapted to spray fuel. A valve element 442 is disposed in the valve cavity 460 of the nozzle housing 426, the valve element 442 being operable between a closed position in which the valve element 442 is seated against the valve seat 462 to thereby prevent injection of fuel through the injection hole 34, and an open position in which the valve element 442 is lifted off the valve seat 462 to thereby allow injection of fuel through the injection hole 34. As can be seen, in accordance with the illustrated embodiment, because the nozzle housing 426 functions as the nozzle support portion of the prior embodiments, the outer peripheral surface 429 of the nozzle housing 426 directly contacts the coolant jacket sleeve 4 installed in the injector bore of the cylinder head 2. In this regard, because there is not a separate component interfacing with the nozzle housing 426, there is no interface in which hot combustion gases can enter and accumulate in the nozzle 412. It should also be noted that while in the illustrated embodiment, the outer peripheral surface 429 of the nozzle housing 426 is preferably conical in shape, other embodiments having different shapes may also be used. Moreover, in other fuel injector applications, the outer peripheral surface 429 of the nozzle housing 426 can directly contact the cylinder head 2 if the injector bore is not be provided with the coolant jacket sleeve 4 as shown. Consequently, in this manner, the illustrated embodiment of FIG. 6 also attains the objects of the present invention noted previously to thereby provide a nozzle with improved cooling.

Figure 7:
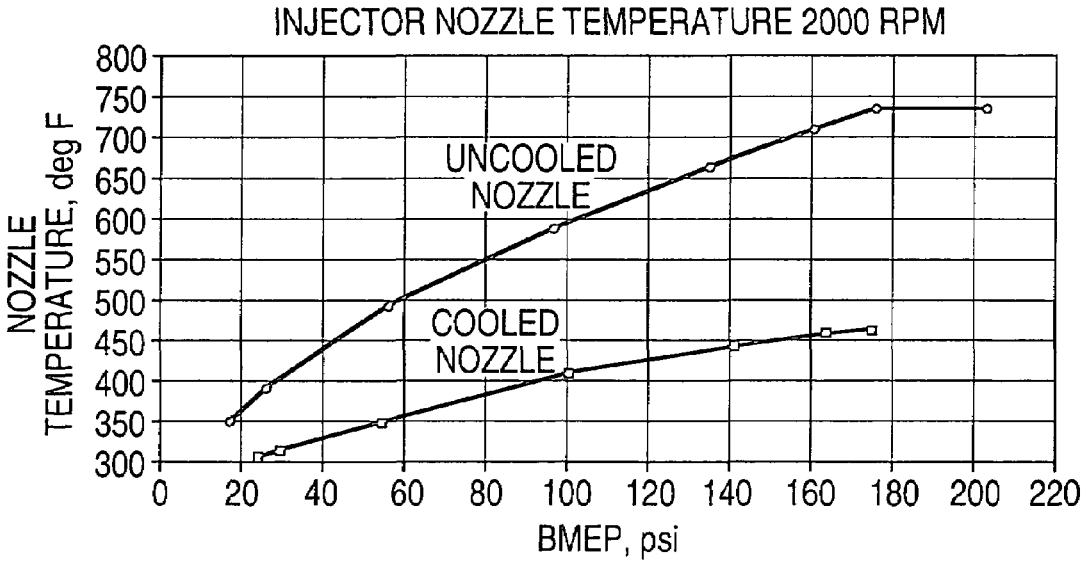
FIG. 7 is a graph empirically illustrating the reduction in nozzle temperature in a fuel injector in accordance with one embodiment of the present invention as compared to nozzle temperature in a fuel injector of the prior art.

The previously noted advantages in improved cooling have been empirically confirmed by the present inventors, the results being illustrated in FIG. 7. The nozzle temperature of a fuel injector having a conventional prior art nozzle was measured and plotted as the line marked "Uncooled Nozzle" in FIG. 7. The nozzle temperature of a fuel injector having the nozzle design in accordance with the present invention as illustrated in FIG. 2 discussed above was also measured and plotted as the line marked "Cooled Nozzle" in FIG. 7. These fuel injectors were operated as pilot injectors with low injection volumes of approximately 5 $mm^3$/stroke in an internal combustion engine operating at 2000 revolutions per minute (RPM) at various Brake Mean Effective Pressure (BMEP, i.e. engine load) having the units pounds per square inch (psi). As can be seen, the nozzle incorporating the tapered interface TI features of FIG. 2 discussed previously operated at much lower nozzle temperatures than the fuel injector having the prior art nozzle. At BMEP of 100 psi, the temperature of the Uncooled Nozzle of the prior art was measured at approximately 600° F. while the Cooled Nozzle temperature was measured at approximately 410° F. thereby achieving a nozzle temperature reduction of approximately 190° F. At increased BMEP, the nozzle temperature reduction attained by the present invention was even more significant. At BMEP of 175 psi, the temperature of the Uncooled Nozzle of the prior art was measured at approximately 730° F. while the Cooled Nozzle temperature was measured at approximately 470° F. thereby achieving a nozzle temperature reduction of approximately 260° F. This reduction in operating temperature of the nozzle is important in ensuring increased reliability and performance. In particular, by reducing the operating temperature of the nozzle, nozzles incorporating the features of the present invention as described above minimize injector coking and damage thereby allowing the injector with such a nozzle to be utilized for pilot injections and for injection of alternative fuels. Similar nozzle temperature reductions can also be attained in the various other embodiments of the present invention as illustrated in FIGS. 3, 4, 5 and 6 by incorporating the various features described in detail above.

From the foregoing, it should now be apparent to a person of ordinary skill in the art how the present invention provides an improved fuel injector which have nozzles with improved cooling. It should also be evident that nozzles incorporating the features of the present invention have increased reliability and performance which is the resultant of the improved cooling. In this regard, it should be clear that the present invention seals the nozzle to thereby prevent heat transfer from the entry of combustion gases into the nozzle. Consequently, the present invention minimizes the problems associated with high nozzle temperatures present in prior art fuel injectors, especially when injectors are used for pilot injections or alternative fuels are used.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

We claim:

1. A closed nozzle fuel injector with improved cooling, said fuel injector being sized to be received in an injector bore of a cylinder head of an internal combustion engine, said fuel injector comprising:

a substantially tubular retainer having a proximal end with a nozzle support portion, said nozzle support portion having an outer peripheral surface and an engagement opening with an inner peripheral surface; and a nozzle housing received within said retainer at said proximal end, said nozzle housing including an integral nozzle shank with an outer peripheral surface and a longitudinal axis, said integral nozzle shank having an elongated shape in which a longitudinal axial dimension of said integral nozzle shank along said longitudinal axis is larger than a diameter of said outer peripheral surface of said integral nozzle shank, said integral nozzle shank further having an elongated valve cavity adapted to receive a valve element therein, and a plurality of injection holes at a tip of the nozzle shank which are adapted to spray fuel when said valve element is moved within said elongated valve cavity, said valve element contacting said integral nozzle shank to prevent flow to said at least one injection hole when said valve element is closed in said elongated valve cavity;

wherein said integral nozzle shank and said nozzle support portion define an annular portion of said engagement opening between said integral nozzle shank and said nozzle support portion, and said inner peripheral surface of said nozzle support portion has a diameter adjacent to said tip that is smaller than said diameter of said outer peripheral surface of said integral nozzle shank adjacent to said tip in a manner that an interference fit exists at a seal interface between said integral nozzle shank and said nozzle support portion, said seal interface being positioned adjacent to said tip of the nozzle shank when said integral nozzle shank is installed in said nozzle support portion to prevent combustion gas from passing through said seal interface and entering said annular portion of said engagement opening between said integral nozzle shank and said nozzle support portion, said retainer engaging an outer barrel, and having a longitudinal axial dimension along said longitudinal axis of said nozzle housing that is larger than said longitudinal axial dimension of said integral nozzle shank.

2. The fuel injector of claim 1, wherein the diameter of the inner peripheral surface of said nozzle support portion is sized approximately 0.00005 to 0.001 inch smaller than the diameter of said outer peripheral surface of said nozzle shank.

3. The fuel injector of claim 2, wherein the diameter of the inner peripheral surface of said nozzle support portion is sized approximately 0.0001 to 0.0006 smaller than the diameter of said outer peripheral surface of said nozzle shank.

4. The fuel injector of claim 1, wherein said nozzle support portion includes a chamfer adapted to facilitate installation of said nozzle shank into said nozzle support portion.

5. The fuel injector of claim 4, wherein the diameter of the inner peripheral surface of said nozzle support portion is sized approximately 0.00005 to 0.001 inch smaller than the diameter of said outer peripheral surface of said nozzle shank.

6. The fuel injector of claim 5, wherein the diameter of the inner peripheral surface of said nozzle support portion is sized approximately 0.0001 to 0.0006 inch smaller than the diameter of said outer peripheral surface of said nozzle shank.

7. The fuel injector of claim 1, wherein the nozzle shank is press fitted into said engagement opening of said nozzle support portion.

8. The fuel injector of claim 1, wherein said retainer further includes a nozzle sleeve and said nozzle support portion is provided on said nozzle sleeve.

9. A closed nozzle fuel injector with improved cooling for an internal combustion engine comprising:

a substantially tubular retainer means having a proximal end with a nozzle support portion, said nozzle support portion having an outer peripheral surface and an engagement opening with an inner peripheral surface; and a nozzle housing received within said retainer means at said proximal end, said nozzle housing including an integral nozzle shank with an outer peripheral surface and a longitudinal axis, said integral nozzle shank having an elongated shape in which a longitudinal axial dimension of said integral nozzle shank along said longitudinal axis is larger than a diameter of said outer peripheral surface of said integral nozzle shank, said integral nozzle shank further having an elongated valve cavity adapted to receive a valve element therein, and a plurality of injection holes at a tip of the nozzle shank which are adapted to spray fuel when said valve element is moved within said elongated valve cavity, said valve element contacting said integral nozzle shank to prevent flow to said at least one injection hole when said valve element is closed in said elongated valve cavity;

wherein said integral nozzle shank and said nozzle support portion define an annular portion of said engagement opening between said integral nozzle shank and said nozzle support portion, and said inner peripheral surface of said nozzle support portion has a diameter adjacent to said tip that is smaller than said diameter of said outer peripheral surface of said integral nozzle shank adjacent to said tip in a manner that an interference fit exists at a seal interface between said integral nozzle shank and said nozzle support portion, said seal interface being positioned adjacent to said tip of the nozzle shank when said integral nozzle shank is installed in said nozzle support portion to prevent combustion gas from entering said annular portion of said engagement opening between said integral nozzle shank and said nozzle support portion, said retainer means engaging an outer barrel, and having a longitudinal axial dimension along said longitudinal axis of said nozzle housing that is larger than said longitudinal axial dimension of said integral nozzle shank.

10. A closed nozzle fuel injector with improved cooling for an internal combustion engine comprising:

a substantially tubular retainer having a proximal end with a nozzle support portion, said nozzle support portion having an outer peripheral surface and an engagement opening with an inner peripheral surface;

a nozzle housing received within said retainer at said proximal end, said nozzle housing including an integral nozzle shank with an outer peripheral surface and a longitudinal axis, said integral nozzle shank having an elongated shape in which a longitudinal axial dimension of said integral nozzle shank along said longitudinal axis is larger than a diameter of said outer peripheral surface of said integral nozzle shank, said integral nozzle shank further having an elongated valve cavity adapted to receive a valve element therein, and a plurality of injection holes at a tip of the nozzle shank which are adapted to spray fuel when said valve element is moved within said elongated valve cavity, said valve element contacting said integral nozzle shank to prevent flow to said at least one injection hole when said valve element is closed in said elongated valve cavity; and a barrel that engages said substantially tubular retainer;

wherein said integral nozzle shank and said nozzle support portion define an annular portion of said engagement opening between said integral nozzle shank and said nozzle support portion, and said inner peripheral surface of said nozzle support portion has a diameter adjacent said tip that is smaller than said diameter of said outer peripheral surface of said integral nozzle shank adjacent to said tip in a manner that an interference fit exists at a seal interface adjacent to said tip of the nozzle shank between said integral nozzle shank and said nozzle support portion when said integral nozzle shank is installed in said nozzle support portion to prevent combustion gas from entering said annular portion of said engagement opening between said integral nozzle shank and said nozzle support portion through said seal interface, said retainer having a longitudinal axial dimension along said longitudinal axis of said nozzle housing that is larger than said longitudinal axial dimension of said integral nozzle shank.

11. A closed nozzle fuel injector with improved cooling, said fuel injector comprising:

a substantially tubular retainer having a proximal end with a nozzle support portion, said nozzle support portion having an outer peripheral surface and an engagement opening with an inner peripheral surface; and a nozzle housing received within said retainer at said proximal end, said nozzle housing including an integral nozzle shank with an outer peripheral surface and an elongated valve cavity adapted to receive a valve element therein, and a plurality of injection holes at a tip of the nozzle shank which are adapted to spray fuel when said valve element is moved within said elongated valve cavity, said valve element contacting said integral nozzle shank to prevent flow to said at least one injection hole when said valve element is closed in said elongated valve cavity;

wherein said integral nozzle shank and said nozzle support portion define an annular portion of said engagement opening, and said inner peripheral surface of said nozzle support portion has a diameter adjacent to said tip that is smaller than said diameter of said outer peripheral surface of said integral nozzle shank adjacent to said tip in a manner that an interference fit exists at a seal interface between said integral nozzle shank and said nozzle support portion that is positioned adjacent to said tip of the nozzle shank to prevent combustion gas from passing through said seal interface and entering said annular portion of said engagement opening, said retainer engaging an outer barrel, and having a longitudinal axial dimension along said longitudinal axis of said nozzle housing that is larger than said longitudinal axial dimension of said integral nozzle shank.

* * * * *